US006223940B1

(12) United States Patent
Quinn

(10) Patent No.: US 6,223,940 B1
(45) Date of Patent: May 1, 2001

(54) FLUID STORAGE CONTAINER AND DISPENSER, AND METHOD OF DISPENSING

(75) Inventor: David G. Quinn, Grayslake, IL (US)

(73) Assignee: Radius International Limited Partnership, Grayslake, IL (US)

( * ) Notice: Subject to any disclaimer, the term of this patent is extended or adjusted under 35 U.S.C. 154(b) by 0 days.

(21) Appl. No.: 09/422,561

(22) Filed: Oct. 21, 1999

Related U.S. Application Data

(63) Continuation-in-part of application No. 09/188,764, filed on Nov. 9, 1998.

(51) Int. Cl.[7] ..... B67D 5/00
(52) U.S. Cl. ..... 222/81; 222/89; 222/90
(58) Field of Search ..... 222/80, 81, 83, 222/83.5, 89, 90

(56) References Cited

U.S. PATENT DOCUMENTS

| | | | | |
|---|---|---|---|---|
| 1,889,557 | * | 11/1932 | Lange | 222/83.5 |
| 3,813,009 | * | 5/1974 | Lenz | 222/81 |
| 4,234,103 | | 11/1980 | Strobl, Jr. et al. . | |
| 4,640,424 | | 2/1987 | White . | |
| 4,801,007 | | 1/1989 | Rule . | |
| 5,325,995 | | 7/1994 | Harrison et al. . | |
| 5,397,026 | | 3/1995 | Mayes . | |
| 5,551,606 | | 9/1996 | Rai et al. . | |
| 5,645,913 | | 7/1997 | Rogers . | |
| 5,718,383 | | 2/1998 | Smith et al. . | |
| 5,855,223 | | 1/1999 | Halonen . | |
| 5,855,298 | | 1/1999 | Teetsel, III et al. . | |
| 5,934,048 | | 8/1999 | Bouressa . | |

* cited by examiner

*Primary Examiner*—Kevin Shaver
*Assistant Examiner*—Thach H Bui
(74) *Attorney, Agent, or Firm*—Richard G. Lione; Brinks Hofer Gilson & Lione

(57) ABSTRACT

A plastic film fluid storage bag and dispensing spike assembly and method wherein the spike punctures the film and forms a fluid tight seal with the film surrounding a hole formed by the puncture. The film has no separate port structure for dispensing its contents. The spike may include a bulbous body with a sharpened tip at one end, an enlarged central portion, and a reduced diameter portion at its opposite end, adjacent a radially extending skirt. When seated, a seal is created around the smaller diameter portion of the body and against the skirt. The spike may alternatively include a cylindrical body with a slightly rounded point at one end and a radially extending skirt intermediate its ends. Finally, the cylindrical body spike may be used without a skirt. In all cases, a fluid passage extends through the body.

15 Claims, 6 Drawing Sheets

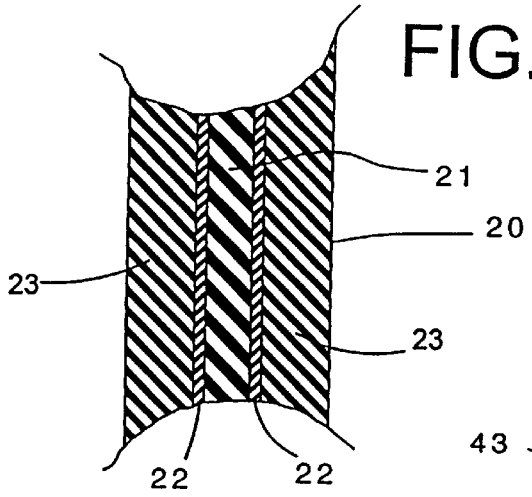
FIG. 2
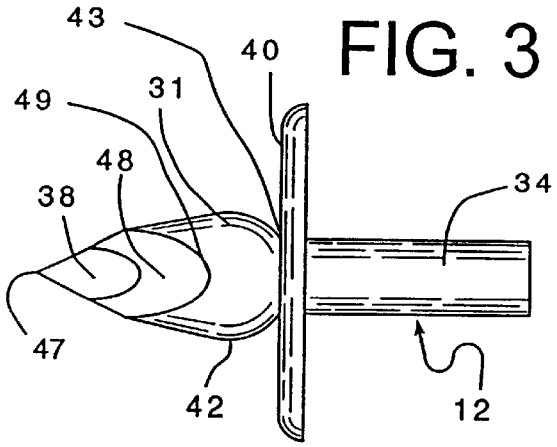
FIG. 3
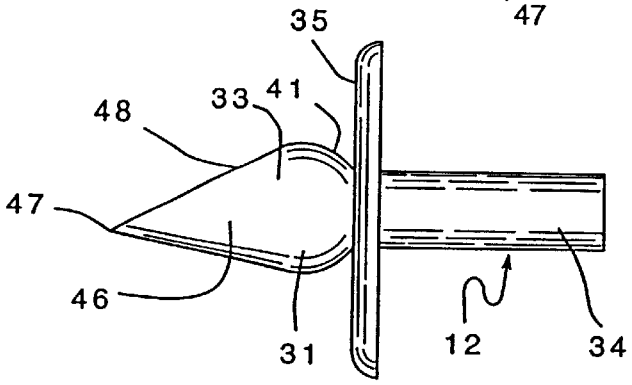
FIG. 4
FIG. 5
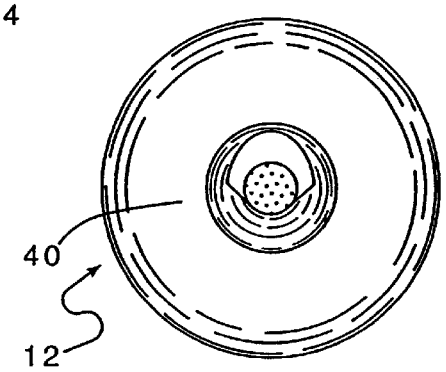

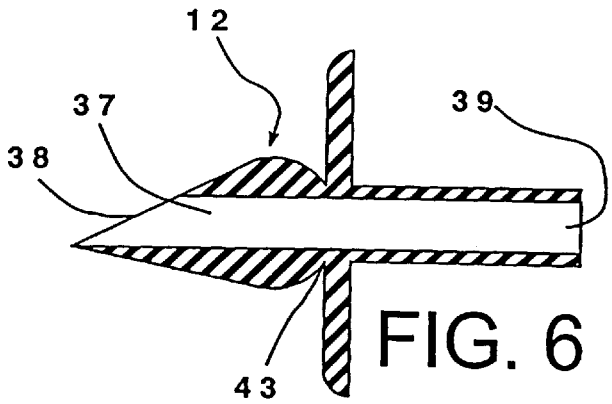
FIG. 6
FIG. 7
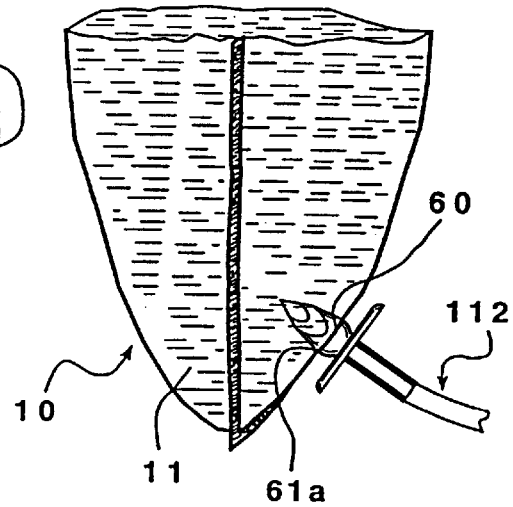
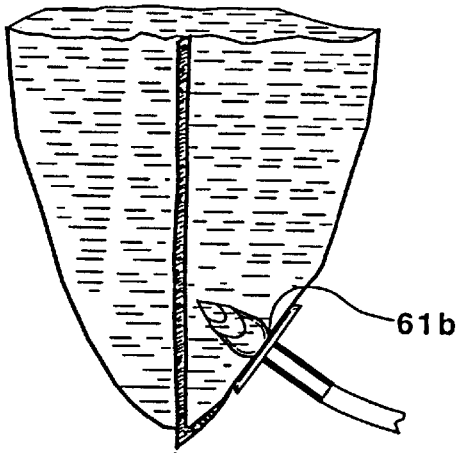
FIG. 8
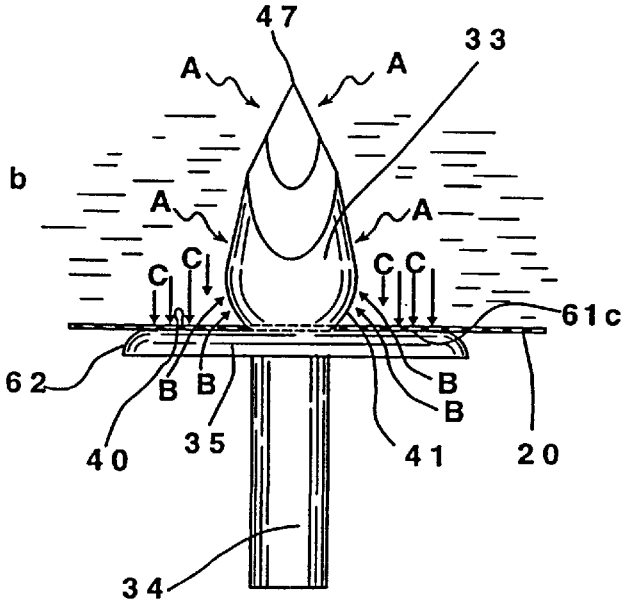
FIG. 9

FIG. 13
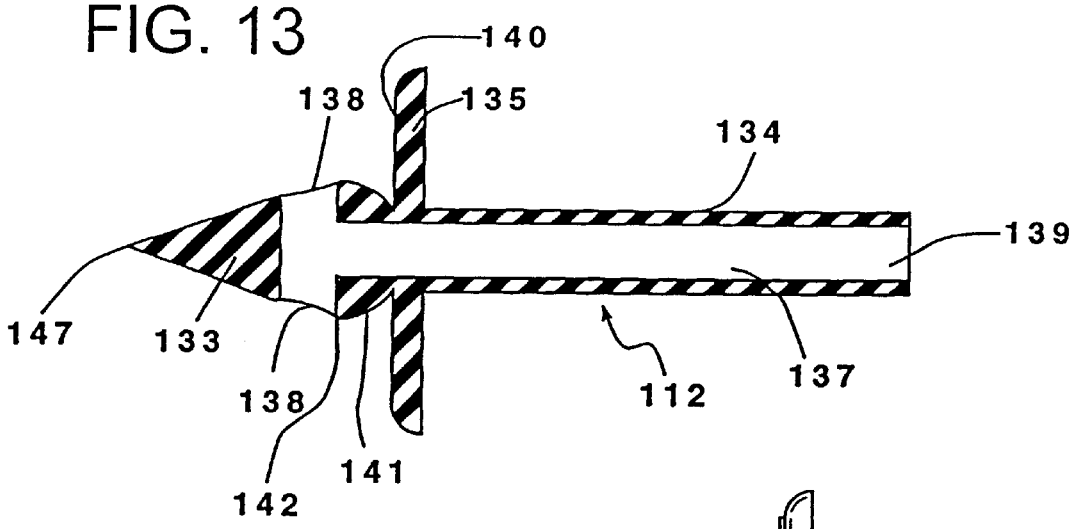
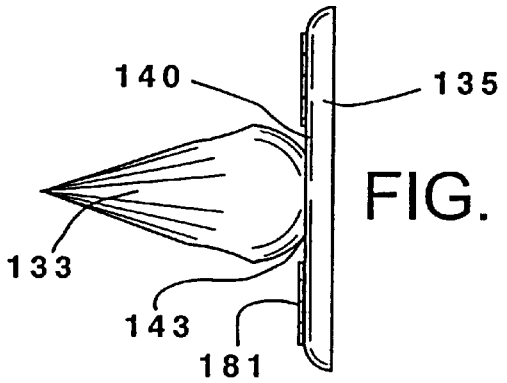
FIG. 14
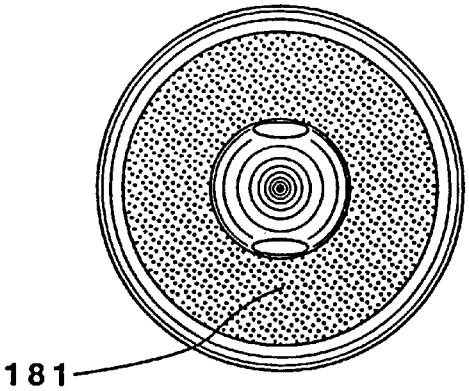
FIG. 15
FIG. 16
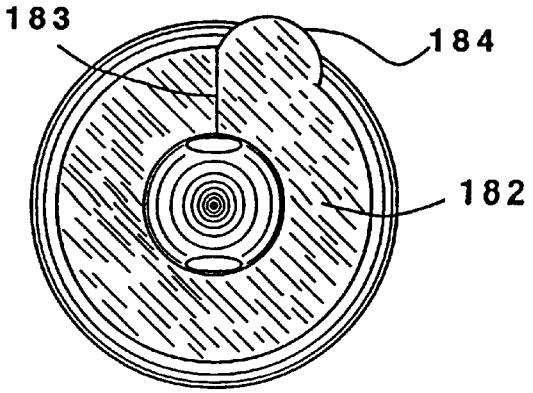

FLUID STORAGE CONTAINER AND DISPENSER, AND METHOD OF DISPENSING

RELATED APPLICATION

This application is a continuation-in-part of application Ser. No. 09/188,764, filed Nov. 9, 1998, for a FLUID STORAGE CONTAINER AND DISPENSER, AND METHOD OF DISPENSING.

BACKGROUND OF THE INVENTION

Bags made of flexible material have been used since antiquity for the storage and dispensing of fluids. Wine and water storage bags made from animal skins are still in use, just as they were in antiquity. Latex rubber bags with attached hoses and probes found early use administering enemas in the medical field. All such bags have openings formed in them during manufacture for manually filling the bag with liquid, as well as for dispensing it.

In 1969 Baxter Laboratories introduced the first intravenous formula storage and dispensing bag. This bag differed from conventional bags in that the fluid was introduced in the manufacturing process and the bag was then sealed and sterilized for shipment to the customer. The bag offered a number of advantages over glass bottles previously used for this purpose. It was lighter, stronger and more compact, making it easier to ship and store. Because it was collapsible, it did not require a separate venting mechanism to allow air to enter as it was emptied. Elimination of the vent simplified the emptying process. No vent was needed in the administration set bag connector, either, and inadvertent administration of air to the patient was prevented.

The liquid formula in these prior art intravenous formula bags was normally dispensed with a dispensing spike which was forced through a dispensing port structure on the bag. The port structure was sealed into the bag during manufacture by laminating it between the two sheets of plastic film from which the bag was constructed. The port structure normally comprised a rigid plastic tube having an internal lumen obstructed by a thin, molded plastic septum. The spike, which was molded of rigid plastic, was used to puncture the septum. Fluid could then flow out of the bag through the spike. The spike was held in place by a friction fit in the lumen.

Generally, such a spike would be a component of an administration set designed to deliver the fluid to a patient or to some other container, or location, for use. In its most common form, the spike is connected to a length of plastic tubing. The tubing normally terminates with a connector designed to facilitate final delivery. In the case of an intravenous solution, the administration set connector is usually designed to be connected to a needle.

Incorporating a port in a bag in the aforedescribed manner remains the most common method of fabrication today. The method is effective, but relatively costly because of the need for a separate port structure and a secondary fabrication operation to seal the port structure between the two film layers of the bag. In addition, the seal area around the port structure has a tendency to leak.

Attempts have been made to improve dispensing systems for sealed bags by gluing a port structure to the outer surface of a bag. Such a system is illustrated in the Kuhn et al. U.S. Pat. Nos. Des. 361,838 and 338,726. In this system, the port structure has no internal septum, i.e., the bag wall is punctured by a dispensing spike. This greatly simplifies the fabrication of the bag because no port structure need be incorporated during fabrication. The elimination of a port structure which must be assembled with the bag is especially important with modern bag manufacturing technology where bags are formed, filled and sealed in a continuous, high speed process. By gluing the port structure onto the bag surface after forming, filling and sealing, manufacturing problems are greatly reduced. However, this system still requires a separate port structure, and an additional operation is needed to attach it to the bag by gluing, for example.

In the aforedescribed prior art systems the dispensing spikes are similar. They each have a sharp, piercing tip on one end of an elongated spike body containing a fluid passage. There is a very slight taper from the tip to a flange surrounding the body, and spaced from the tip, which serves as a stop. Retention, and a tight, non-leaking fit, are obtained by the friction fit of the spike body in the port structure. In one case, the spike pierces the bag wall itself. In the other case, the spike pierces a septum in the port structure.

SUMMARY OF THE INVENTION

An object of the present invention is to provide a new and improved plastic film storage bag and dispenser for dispensing fluid from the bag.

Another object is to provide a new and improved plastic film storage bag and dispenser for dispensing fluid from the bag wherein the bag does not require a separate port structure which is integral with, or fastened to, the bag.

Still another object is to provide a new and improved plastic film storage bag and dispenser for dispensing fluid from the bag wherein the plastic film forms a fluid tight seal with the dispenser when the film is punctured by the dispenser.

A further object is to provide a new and improved plastic film storage bag and dispenser for dispensing fluid from the bag wherein the dispenser is a plastic dispensing spike which cooperates with the plastic film to form a fluid tight seal when the spike pierces the film and is seated.

Yet a further object is to provide a new and improved dispensing spike for plastic film storage bags.

Another object is to provide a new and improved method of dispensing fluid from plastic film storage bags.

The foregoing and other objects are realized in accord with the present invention by providing a plastic film storage bag and dispenser for dispensing fluid from the bag. The dispenser comprises a dispensing spike which penetrates the wall of the bag but does not require a separate port structure.

In a first embodiment of the invention, the spike includes a tear drop shaped body which terminates in a sharp point. The body pierces the film wall of the bag, point first. The body progressively stretches the film to form a hole of increasing diameter. After the largest diameter portion of the body passes through the film, the film around the hole progressively contracts elastically, following a bulbous face of the body until it reaches a reduced diameter end of the body, opposite the point. A skirt extends radially outwardly adjacent this reduced diameter end. The plastic film of the bag contracted around the hole grips the reduced diameter end of the spike between the bulbous face of the body and the skirt adjacent it.

With the spike inserted into the bag in this manner, the contracted film around the hole in the film forms a fluid tight seal with the reduced diameter circumference of the body between the bulbous face of the body and the skirt. The pressure exerted by the fluid in the bag is normally effective to press the film tightly against the skirt and increase the effectiveness of the seal while retaining the puncture spike even more securely in the bag. At the same time, the fluid pressure in the bag acting on the bulbous face of the body, where it faces the skirt, is normally effective to balance pressure acting on inwardly facing surfaces of the body and, accordingly, oppose the forces which would otherwise tend to expel the spike from the bag.

In one variation of the first embodiment, a fluid outlet passage extends longitudinally through the entire spike, opening through a flattened side of a conical tip on the body. In this variation of the invention, the conical tip is inclined to the longitudinal axis of the spike.

In another variation of the first embodiment, the fluid outlet passage is tee-shaped. The cross-passage of the tee opens through both sides of a conical tip which is concentric with the longitudinal axis.

In a modification of the spike embodying features of either of the aforedescribed variations of the invention, a circular strip of adhesive is placed on the flange, adjacent the reduced diameter end of the bulbous body. The inner diameter of the circular strip corresponds to the outer diameter of the bulbous body at its maximum diameter. The outer diameter of the strip is slightly less than the outside diameter of the flange. When the dispensing spike pierces the bag in the aforedescribed manner, the adhesive adheres to the outer surface of the bag to further enhance the sealing relationship between the flange and the bag.

In a second embodiment of the invention, the spike includes a straight cylindrical body which is joined to a conical tip by a curved profile transition section. The tip has a slightly rounded point at its free end. A fluid outlet passage in the spike is tee-shaped. A cross-passage of the tee opens through both sides of the transition section, immediately adjacent the cylindrical body. A skirt encircles the body a short distance from the transition section.

In a third embodiment of the invention the spike is substantially identical to the second embodiment, except that the skirt is eliminated. This embodiment of the invention finds particularly advantageous application as a built-in dispensing spike in a fluid dispenser unit.

BRIEF DESCRIPTION OF THE DRAWINGS

The invention, including its construction and method of operation, is illustrated more or less diagrammatically in the accompanying drawings, in which:

FIG. 2 is enlarged sectional view through the plastic film from which the dispensing bag seen in FIG. 1 is fabricated;

FIG. 3 is a top plan view of the dispensing spike comprising a first embodiment of the invention;

FIG. 4 is a side elevational view of the spike shown in FIG. 3;

FIG. 5 is an end view of the spike shown in FIG. 3;

FIG. 6 is a longitudinal sectional view through the spike shown in FIG. 3;

FIG. 7 is an enlarged sectional view through one end of the bag and spike assembly illustrated in FIG. 1, with the spike shown in FIGS. 3–6 partially inserted;

FIG. 8 is a further enlarged sectional view of the bag and spike assembly shown in FIG. 7, with the spike fully inserted;

FIG. 9 is an enlarged view of the bag and spike assembly shown in FIG. 8;

FIG. 13 is a longitudinal sectional view through the spike shown in FIG. 10;

FIG. 14 is a view similar to FIG. 11 showing an added seal feature of the invention on the dispensing spike of FIGS. 10–13;

FIG. 15 is an end view of the spike and seal feature shown in FIG. 14, ready for use;

FIG. 16 is an end view similar to FIG. 15 showing a protective element used on the seal feature prior to use;

DESCRIPTION OF THE PREFERRED EMBODIMENT

Figure 1:
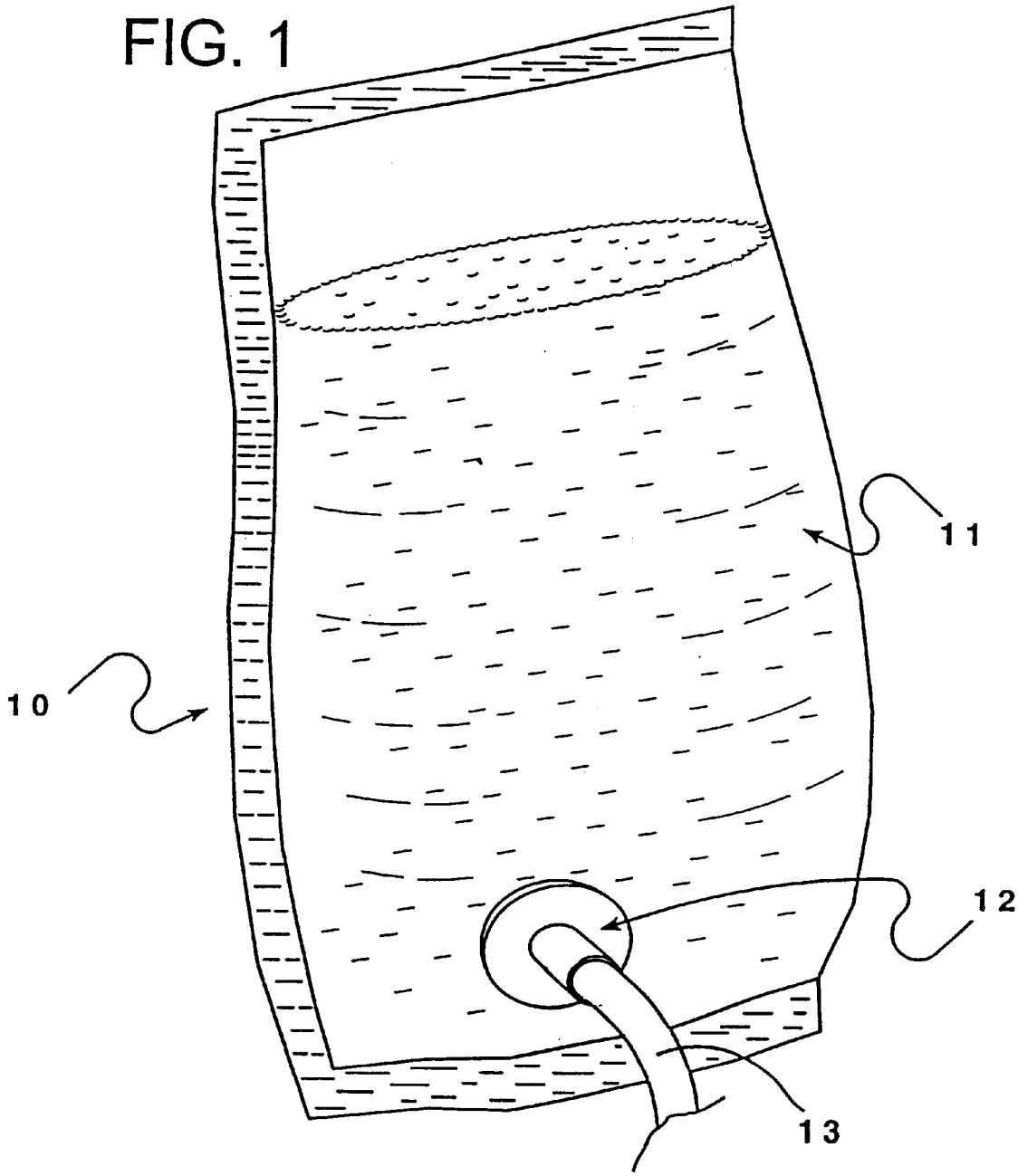
FIG. 1 is a perspective view of a fluid storage bag assembled with a dispensing spike comprising a first embodiment of the invention.
Figure 10:
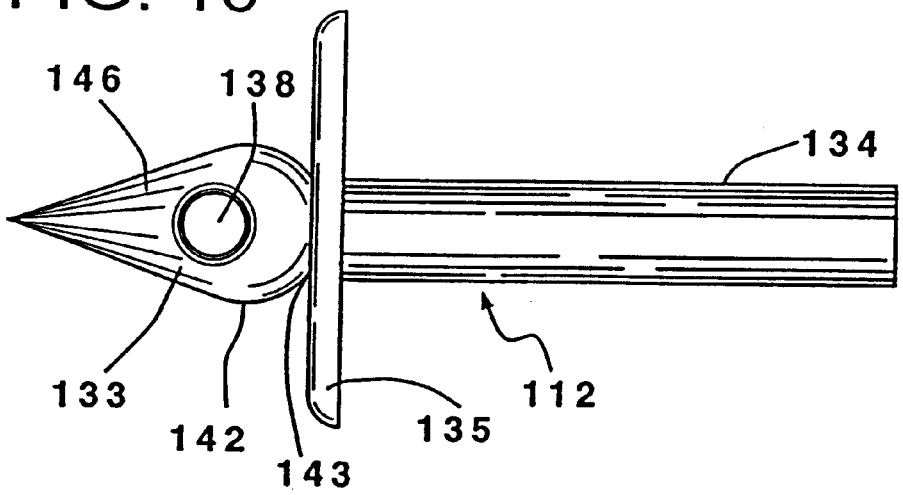
FIG. 10 is a top plan view, similar to FIG. 3, showing a dispensing spike comprising a second embodiment of the invention.

Referring now to the drawings, and particularly to FIG. 1, a food formula bag and dispensing spike assembly embodying features of the present invention is seen generally at 10. The assembly 10 includes a bag 11 formed of plastic film and a dispensing spike 12 molded of plastic. The bag 11 is filled with a liquid food formula F. The assembly 10 is shown in FIG. 1, immediately after the spike 12 has been inserted in the bag 11 but prior to food formula being dispensed. The dispensing spike 12 has a conventional dispensing tube 13 attached.

The bag 11 shown here is used as a container for food formulas where relatively long term storage is contemplated and where it is important to prevent admission of moisture or gas (normally oxygen) over such a term. To this end, the bag 11 is fabricated from a multi-layer plastic film 20.

Referring to FIG. 2, the film 20 comprises a central layer 21 of ethylvinylacetate (EVA) which is 0.001 inches thick. This layer 21 has very high moisture and gas transmission resistance. Opposite sides of the central layer 21 are coated with thin layers 22 of Surlyn (a product of E. I. Dupont Nemours) which functions as an adhesive. Outside of the Surlyn adhesive layer 22, on each side of the film 20, is a low density polyethylene layer 23 which is approximately 0.0015 inches thick. The film 20 is, accordingly, 0.0045 inches thick.

The bag 11 is formed and filled in a conventional manner by what is known as a "vertical form, fill and seal" machine. In such a machine, a continuous sheet of the film 20 which is approximately twice the width of a bag 11 is fed (from a roll) through a hydrogen peroxide bath to sterilize it. Residual hydrogen peroxide is removed from the sheet. The sheet is then folded in half, lengthwise, so as to bring the two free side edges together. A continuous seal is made by impulse heating sealing along the two mating side edges. This fastens the edges together in fluid tight relationship and forms a tube.

A continuous seal is then also made across the tube at a predetermined location to form a fluid tight bottom in a bag created above this seal. A predetermined amount of formula is introduced into the tube from the open, upper end of the tube. The tube is then sealed above the liquid by impulse heat sealing it, in a manner previously described, across the folded sheet. The tube is cut through the middle of the top seal, leaving a filled, sealed bag below and the bottom seal of a new bag in the tube above. The process is then repeated with the new bag formed above.

The filled bag 11 is formed without an access port in it, according to the invention. When formula F is to be dispensed, the dispensing spike 12 is used to puncture the bag 11, in a manner hereinafter discussed, creating the bag and spike assembly 10 seen in FIG. 1.

Referring now to FIGS. 3–6, the dispensing spike 12 comprising features of a first embodiment of the invention is shown separately. The spike 12 is molded in one piece from plastic. The plastic is, in the present illustration, a polyamide, and the spike is relatively rigid when molded in a conventional manner.

The spike 12 shown here is 1.598 inches long. It consists of a tear drop shaped body 33 at one end and a dispensing pipe 34 at the other end, with a radially extending skirt 35 between them. The body 33 is 0.542 inches long, the pipe 34 is 1.000 inches long and the intervening skirt 36 is 0.056 inches thick. The diameter of the skirt 35 is 0.750 inches.

A fluid passage 37 extends longitudinally through the spike 12, from an inlet 38 in the body 33 to an outlet 39 in the dispensing pipe. The inside diameter of the passage 37 is 0.114 inches. The outside diameter of the pipe 34 is 0.166 inches, making the wall of the pipe 0.052 inches thick.

The skirt 35 has a flat inner face 40 immediately adjacent the body 33 of the spike 12. A bulbous face 41 of the body 33, immediately adjacent and opposing the face 40, is substantially semi-spherical in shape, with a radius of 0.143 inches. The face 41 curves inwardly from a maximum diameter of 0.286 inches at the outermost circumference 42 of the body 33 to a minimum diameter of 0.166 inches at an inner circumference 43 of the body 33 where it meets the face 40 of the skirt 35. It will thus be seen that the body 33 is bulbous in shape and substantially larger in outside diameter than the pipe 34.

Opposite the bulbous face 41 on the body 33 is a conical piercing tip 46. The conical piercing tip 46 terminates in a sharp point 47. The tip 46 is inclined slightly to the longitudinal axis of the spike 12 and has a flat face 48 on one side at an angle of 27° to the axis. This produces the somewhat elliptically shaped inlet 38 in the face 48. The face 48 is 0.046 inches long, from one end at the point 47 on the tip 46 to the opposite end at 49. The tip is 0.426 inches long between the point 47 and the outermost circumference 42 of the body 33.

Referring now to FIGS. 7–9, the bag and spike assembly 10 and the method of inserting the spike 12 according to the invention are illustrated. As seen in FIG. 7, the spike 12, with a dispensing tube 13 connected (to the pipe 34) and closed with a suitable clip (not shown), is pressed into the bag 11, near the bottom of the bag. The sharp point 47 of the spike body 33 pierces the multilayer plastic film 20. A hole 60 is formed in the film 20, and that hole expands elastically as the spike body 33 penetrates.

When the spike body 33 has penetrated to the point where its maximum diameter has passed through the hole 60, the elasticity of the film 20 causes the hole to contract and the film 20 around it to maintain a fluid tight seal 61*a* with the semi-spherical face 41 of the spike body 33. The spike body 33 continues to penetrate until stopped by the face 40 of the skirt 35, while the film 20 around the hole 60 continues to contract until then. At that point, the film 20 around the hole 60 is elastically gripping the spike body 33 at the circumference line 43 where the body 33 and skirt 35 meet to form a fluid tight seal 61*b* there.

As seen in FIG. 9, fluid pressure forces act on the body 33 when the spike 12 is in properly seated position. Fluid pressure forces acting on the film 20 are also illustrated in the same manner. The effect of fluid pressure forces A tending to expel the spike 12 are opposed by the forces B acting on the semi-spherical face 41 of the body 33 and tending to oppose expulsion.

It has been found that the effect of the elastic film 20 contracted around the hole 60 against the spike body 33 to form seal 61*b* normally is sufficient to prevent fluid leakage from around the spike 12. This sealing is, however, enhanced by an additional seal 61*c* formed between film 20 and the face 40 of the skirt 35. Fluid pressure forces C acting on the film 20 opposite this face 40 create this additional seal. The outer annular edge 62 of the face 40 is rounded off to prevent damage to the film 20 where it crosses this edge.

Figure 11:
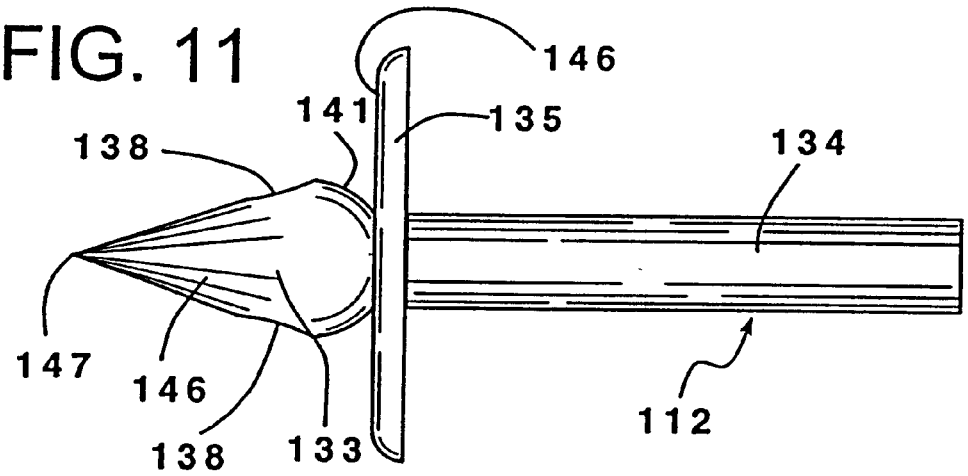
FIG. 11 is a side elevational view of the spike shown in FIG. 10.
Figure 12:
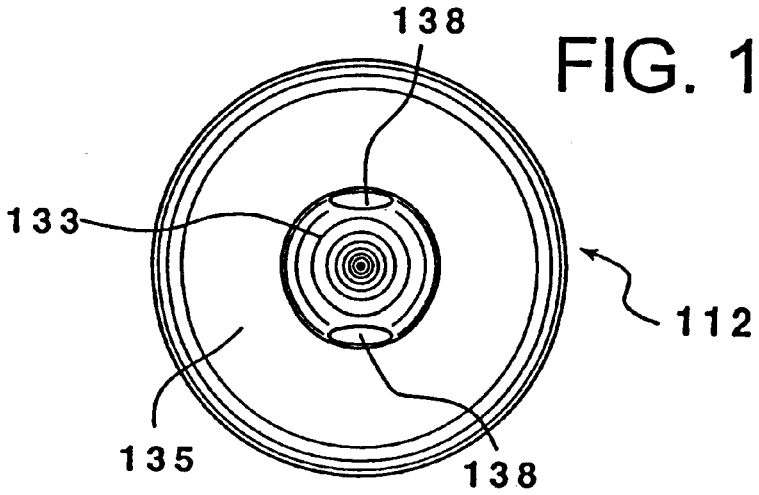
FIG. 12 is an end view of the spike shown in FIG. 10.

Referring now to FIGS. 11–13, a dispensing spike 112 comprising features of a second embodiment of the invention is shown independently. The spike 112 is again molded in one piece from plastic, preferably a polyamide plastic.

In this form of the invention, the spike 112 illustrated is also 1.598 inches long. It consists of a tear drop shaped body 133 at one end and a dispensing pipe 134 at the other end, with a radially extending skirt 135 between them. The body 133 is 0.542 inches long, the pipe 134 is 1.000 inches long and the intervening skirt 136 is 0.056 inches thick.

A tee-shaped fluid passage 136 extends through the spike 112, from a transversely extending passage 138 in the body 133 to an outlet 139 in the longitudinal passage 137 through the dispensing pipe 134. The inside diameter of the passage 137 and the passage 138 is 0.114 inches.

The outside diameter of the pipe 134 is 0.166 inches, making the wall of the pipe 0.052 inches thick. The diameter of the skirt 135 is 0.750 inches.

The skirt 135 has a flat inner face 140 immediately adjacent the body 133 of the spike 112. A bulbous face 141 of the body 133, immediately adjacent and opposing the face 140, is substantially semi-spherical in shape, with a radius of 0.143 inches. The face 141 curves inwardly from a maximum diameter of 0.286 inches at the outermost circumference 142 of the body 33 to a minimum diameter of 0.166 inches at an inner circumference 143 of the body 133 where it meets the face 140 on the skirt 135.

Opposite the bulbous face 141 on the body 133 is its conical piercing tip 146. The piercing tip 146 terminates at a sharp point 147. The transverse inlets 138 open to opposite sides of the conical piercing tip 146, immediately in front of the outermost circumference 142 of the tip. The conical tip is 0.426 inches long between the point 147 and the circumference 142.

The spike 112 is employed in exactly the same manner as the spike 12 previously discussed to penetrate a bag 11 and create a bag and spike assembly 10. The only difference noticeable is a reduction in the amount of fluid leakage which takes place as the hole made by the tip in the bag film passes over the inlet ports to the passage 138. This leakage, which is already minimal with the first embodiment of the invention (because the body 33 of the spike 12 pierces the film so rapidly), is reduced even further because the longitudinal dimension of each inlet port to the passage 138 is less than that of the inlet 38 in the first form of the invention.

Turning now to FIGS. 14–16 a modification of the spike 112 is illustrated. In this modification, a circular strip 181 of adhesive is laid on the face 140 of the skirt 135. The adhesive strip 181 may be a preformed, double-side adhesive strip or it may be applied to the face 140 in liquid form, for example. In either case, a circular strip of wax paper 182, which adheres only loosely to the adhesive, is laid over the adhesive strip 181 to protect it.

The wax paper strip 182 is split at 183, and includes a pull tab at 184. The inner diameter of the strip 182 is the same as that of the adhesive strip 181, and corresponds exactly to the outside diameter of the spike body 133.

The protective strip 182 is placed on the adhesive strip 181 immediately after the adhesive is applied. It is removed immediately prior to using the spike 112 to penetrate the bag 11.

When a spike 112 which carries an adhesive strip 181 is driven into a bag 11, the plastic film around the hole 60 created seats against the adhesive and creates an even more effective seal. This occurs only after the film has contracted around the face 141 of the body 133 to the inner circumference 143 as the spike 112 penetrates, however.

Figure 17:
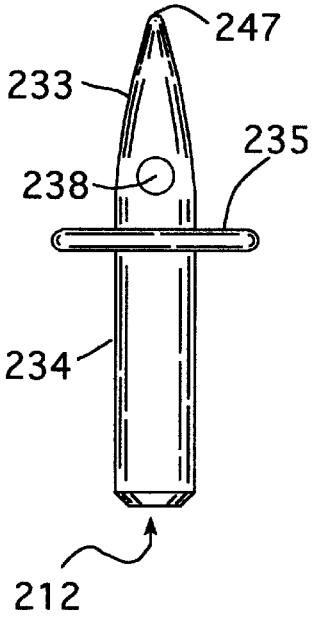
FIG. 17 is a top plan view, similar to FIGS. 3 and 10, showing a dispensing spike comprising a third embodiment of the invention.
Figure 18:
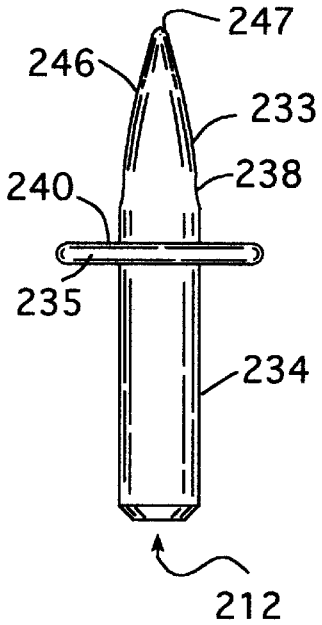
FIG. 18 is a side elevational view of the spike shown in FIG. 17.
Figure 19:
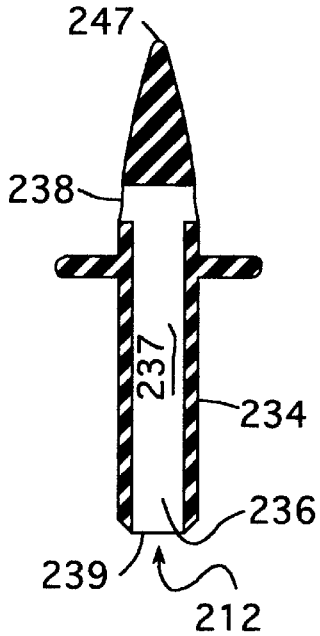
FIG. 19 is a longitudinal sectional view through the spike shown in FIG. 18.

Referring now to FIGS. 17–19, a dispensing spike 212 comprising features of a third embodiment of the invention is shown independently. The spike 212 is also molded in one piece of a polyamide plastic.

In this form of the invention, the spike 212 illustrated is 1.825 inches long. It consists of a bullet shaped body 233 at one end and a dispensing pipe 234 at the other end, with a radially extending skirt 235 between them. The body 233 is 0.778 inches long, the pipe 234 is 0.972 inches long and the intervening skirt 235 is 0.075 inches thick.

A tee-shaped fluid passage 236 extends through the spike 212 from a transversely extending cross-passage 238 in the body 233 to an outlet 239 in the longitudinal passage 237 through the dispensing pipe 234. The inside diameter of the passage 237 is 0.188 inches. The inside diameter of the cross-passage 238 is 0.134 inches. Thus, the cross-sectional area of the cross-passage 238 is one-half that of the passage 237. With two branches, the cross-passage 238 has the same flow capacity as the passage 237 but, because their diameters are reduced, the potential for leakage during insertion is reduced.

The outside diameter of the pipe 234 is 0.288 inches, making the wall of the pipe 0.050 inches thick. The diameter of the skirt 235 is 0.750 inches.

The skirt 235 has a flat inner face 240 immediately adjacent the body 233 of the spike 212. At the opposite end of the body 233, a piercing tip 246 is formed. The tip 246 terminates in a rounded, i.e., segmentally spherical, point 247 having a radius of 0.025 inches.

The outer surface 241 of the front segment or tip 246 in the body 233 is conical in shape, as it extends rearwardly from the rounded point 247, until it is 0.210 inches behind the point. This outer surface 241 of the front segment tapers outwardly at an angle of 15° to the axis of the spike 212.

At an annular line on the outer surface 241 which is 0.210 inches behind the rounded point 247, the surface of the intermediate segment in the body 233 begins curving inwardly until, at 0.655 inches behind the point, the surface 241 of the rear segment in the body 233 becomes circular cylindrical. The diameter of the tip in this circular cylindrical rear segment is 0.288 inches.

As best seen in FIG. 19, the cross-passage 238 opens through the outer surface 241 in the curved intermediate segment of the surface, i.e., just before the surface becomes circular cylindrical. This relationship of cross-passage 238 to the maximum diameter of the body 233 minimizes leakage during insertion.

Figure 20:
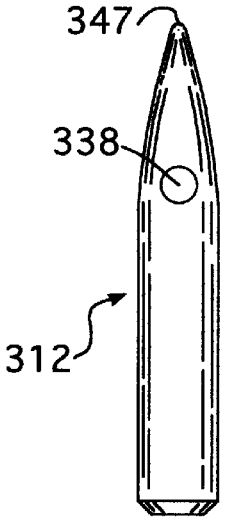
FIG. 20 is a top plan view, similar to FIGS. 3, 10 and 17, showing a dispensing spike comprising a fourth embodiment of the invention.
Figure 21:
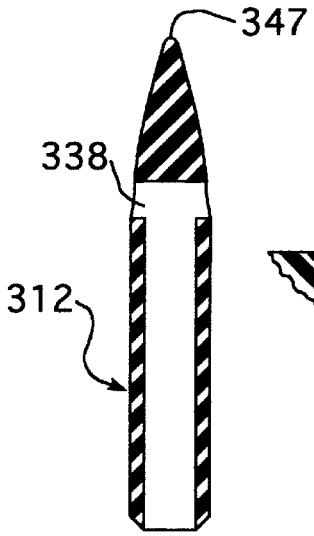
FIG. 21 is a longitudinal sectional view through the spike shown in FIG. 20.
Figure 22:
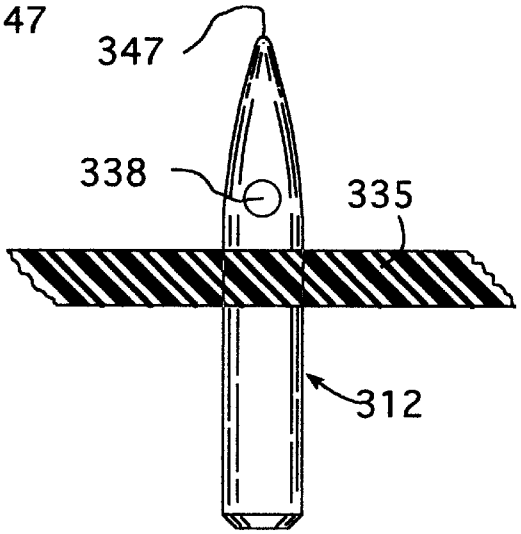
FIG. 22 is a top plan view of the spike of FIGS. 20 and 21 combined in a dispenser according to the invention.

Referring now to FIGS. 20–22, a dispensing spike 312 comprising features of a fourth embodiment of the invention is shown. In FIG. 22 the spike 312 is shown in combination with the base 335 of a dispenser cabinet (only partially shown) in which it is assembled.

The spike 312 is identical in configuration to the spike 212 previously described except, unlike the spike 212 it is machined from a steel rod. Since it is identical, corresponding reference numerals plus 100 digits are applied to corresponding components and no further description is included. The spike 312 is suited to repeated re-use without recognizable wear because it is fabricated of steel and not plastic.

In the spike 312 and dispenser base 335 assembly, the base takes the place of the skirt 235 in the third embodiment, for example. To utilize the assembly, a dispensing bag (not shown) is simply dropped into the dispenser, onto the spike 312. The spike 312 pierces the bag and the dispenser is ready for use.

While preferred embodiments of the invention have been described, it should be understood that the invention is not so limited, and modifications may be made without departing from the invention. The scope of the invention is defined by the appended claims, and all devices that come within the meaning of the claims, either literally or by equivalence, are intended to be embraced therein.

I claim:

1. An assembly of a fluid filled container and a dispensing spike for dispensing fluid from the container, wherein:

a) said container includes a bag having walls formed of unsupported plastic film;

b) said film walls have an inner surface and an outer surface;

c) a dispensing spike extends through a hole formed in said film between said inner and outer surfaces by said spike;

d) said spike includes a body and a dispensing pipe separated by a radially extending skirt;

e) said body extends through said hole into communication with said fluid and said unsupported plastic film is resiliently distended in its own plane by said body so as to grip said body around said hole;

f) said skirt is sealed against said outer surface of said film; and g) a fluid passage extends through said spike body and said pipe.

2. The assembly of claim 1 further characterized in that:

a) said radially extending member comprises a skirt formed unitarily with said body and said pipe.

3. The assembly of claim 2 further characterized in that:

a) said body includes a sharpened tip at one end and has a bulbous shape between said tip and said skirt.

4. The assembly of claim 3 further characterized in that:

a) said bulbous shape body has a reasonably small diameter adjacent said skirt and a larger diameter between said skirt and said tip.

5. The assembly of claim 4 further characterized in that:

a) the plastic film surrounding said hole elastically engages and grips said body at said diameter when said skirt is seated against said outer surface; and b) a fluid tight seal is formed between said plastic film surrounding said hole and said spike body.

6. The assembly of claim 1 wherein:

a) said plastic film is, at least partially, composed of polyethylene.

7. The assembly of claim 1 wherein:

a) said plastic film surrounding said hole is between 0.05 and 0.15 millimeters thick.

8. An access spike for accessing and dispensing fluid from a container for fluids comprising:

a) a body and a skirt;

b) said body having a tip at one end, a larger diameter central portion, and a smaller diameter portion at an opposite end adjacent said skirt;

c) said larger diameter central portion of said body having a bulbous, external configuration; and d) a strip of adhesive on said skirt.

9. The combination of a dispensing spike and plastic film wall in a container, comprising:

a) a spike having body at one end and a dispensing pipe at another end with a radially extending skirt between them;

b) a fluid passage extending longitudinally through said spike from an inlet in said body to an outlet in said pipe;

c) said body having a substantially semi-spherical face adjacent to and opposing a substantially flat face on said skirt;

d) said body having a film piercing tip which terminates at a sharp point extending away from said skirt;

e) said film piercing tip increasing in circumference from said point toward skirt until it reaches a maximum circumference, after which it decreases in circumference until it reaches said skirt;

f) said tip being substantially conical between said point and said maximum circumference; and g) said inlet comprising two openings on opposite sides of said point;

h) said body extending through a hole in said plastic film wall whereby said film seats against said skirt;

i) said plastic film wall being free of any other external or internal support in the area around said hole.

10. A dispensing spike for penetrating a plastic film wall in a container and dispensing fluid from the container, comprising:

a) a spike body at one end and a dispensing pipe at another end with a radially extending skirt between them;

b) a fluid passage extending longitudinally through said spike from an inlet in said body to an outlet in said pipe;

c) said body having a substantially semi-spherical face adjacent to and opposing a substantially flat face on said skirt;

d) said body having a film piercing tip which terminates at a sharp point extending away from said skirt;

e) said film piercing tip increasing in circumference from said point toward said skirt until it reaches a maximum circumference, after which it decreases in circumference until it reaches said skirt;

f) said tip being substantially conical between said point and said maximum circumference;

g) and inlet opening on two sides of said point; and h) an adhesive is applied to said flat face of said skirt.

11. The dispensing spike of claim 10 further characterized by and including:

a) a removable shield covering said adhesive.

12. A dispensing spike for penetrating a plastic film wall in a container and dispensing fluid from the container, comprising:

a) a spike body at one end and a dispensing pipe at the other end;

b) a fluid passage extending through said spike from an inlet in said body to an outlet in said pipe;

c) said body having a substantially bullet-shaped tip terminating in a film piercing point;

d) said fluid passage including an axially extending passage through said pipe connected to a cross passage through said spike body;

e) the cross-sectional area of said cross-passage being about one-half of that of said axially extending passage.

13. A dispensing spike for penetrating a plastic film wall in a container and dispensing fluid from the container, comprising:

a) a spike body at one end and a dispensing pipe at the other end;

b) a fluid passage extending through said spike from an inlet in said body to an outlet in said pipe;

c) said body having a substantially bullet-shaped tip terminating in a film piercing point;

d) said film piercing point being segmentally spherical.

14. The dispensing spike of claim 13 further characterized in that:

(a) said segmentally spherical piercing point has a radius of about 0.025 inches.

15. A dispensing spike for penetrating and forming a liquid tight seal with an unsupported plastic film wall in a container, and dispensing fluid from the container, comprising:

a) a spike body at one end and a dispensing pipe at the other end;

b) a fluid passage extending through said spike from an inlet in said body to an outlet in said pipe;

c) said body having a substantially bullet-shaped tip terminating in a film piercing point;

d) said tip increasing in circumference from said point toward said pipe until it reaches a maximum circumference, which circumference is the same as that of the pipe;

e) said tip being substantially conical with an included angle of about 15° between said point and a line spaced from said point;

f) said inlet comprises openings on two sides of said point;

g) the configuration of said spike body allowing said liquid tight seal to form at said maximum circumference.

* * * * *